US005126080A

United States Patent [19]

Morton et al.

[11] Patent Number: 5,126,080

[45] Date of Patent: Jun. 30, 1992

[54] RAPID ABSORPTION STEAM HUMIDIFYING SYSTEM

[75] Inventors: Bernard W. Morton, Minnetonka; Kirk A. Nelson, Minneapolis, both of Minn.

[73] Assignee: Dri Steem Humidifier Company, Eden Prairie, Minn.

[21] Appl. No.: 687,327

[22] Filed: Apr. 18, 1991

[51] Int. Cl.[5] ..... B01F 3/04

[52] U.S. Cl. ..... 261/118; 55/263; 122/488; 261/DIG. 76

[58] Field of Search ..... 261/118, DIG. 76; 55/263, 264; 122/488, 489

[56] References Cited

U.S. PATENT DOCUMENTS

| | | | |
|---|---|---|---|
| 669,558 | 3/1901 | Stoddard | 122/488 |
| 2,010,859 | 8/1935 | Huet | 122/488 |
| 2,186,125 | 1/1940 | Roberts | 261/DIG. 76 |
| 2,237,417 | 4/1941 | Croft . | |
| 2,949,239 | 8/1960 | Goyette | 261/DIG. 76 |
| 3,096,817 | 7/1963 | McKenna . | |
| 3,134,657 | 5/1964 | Anderson . | |
| 3,566,584 | 3/1971 | Ruthrof et al. | 122/488 |
| 3,642,201 | 2/1972 | Potchen | 261/DIG. 76 |
| 3,724,180 | 4/1973 | Morton | 261/DIG. 76 |
| 3,778,981 | 12/1973 | Ross . | |
| 3,857,514 | 12/1974 | Clifton | 261/DIG. 76 |
| 3,920,423 | 11/1975 | Ross . | |
| 4,384,873 | 5/1983 | Herr | 261/118 |
| 4,818,256 | 4/1989 | Ross . | |

FOREIGN PATENT DOCUMENTS

| | | | |
|---|---|---|---|
| 451261 | 9/1948 | Canada | 122/488 |
| 663306 | 7/1938 | Fed. Rep. of Germany | 122/488 |
| 844011 | 7/1952 | Fed. Rep. of Germany | 122/488 |
| 635416 | 3/1983 | Switzerland | 261/DIG. 76 |

OTHER PUBLICATIONS

Dri-Steem ® Model STS TM 0 Brochure, ©1987 Dri--Steem Humidifier Company, Box 128, Hopkins, Minn., 55343.

Dri-Steem ® Steam Injection Humidifiers for Applications With a Steam Boiler, ©1989 Dri-Steem Humidifier Company.

Vaporstream ® Electric Steam Humidifiers for Applications Without a Steam Boiler-Commercial, Institutional, Industrial and Large Residential, ©1990 Dri-Steem Humidifier Co.

*Primary Examiner*—Tim Miles

*Attorney, Agent, or Firm*—Woodcock Washburn Kurtz Mackiewicz & Norris

[57] ABSTRACT

An improved apparatus for introduicng steam into an airstream in a heating, ventilating and air conditioning system includes a supply header, steam dispersing structure and structure for collecting condensation from the steam dispersing structure. The supply header is adapted for connection to a source of steam and is preferably elevated with respect to the return header, so that condensation in the supply header is forced into the return header under the influence of steam pressure and gravity. Both headers may further be inclined to improve drainage of condensation. The invention optionally may utilize fenders in conjunction with the steam dispersing structure to minimize heat transfer to the airstream.

26 Claims, 5 Drawing Sheets

RAPID ABSORPTION STEAM HUMIDIFYING SYSTEM

BACKGROUND OF THE INVENTION

1. Field of the Invention

This invention relates to humidification systems which are used in heating, ventilating and air conditioning (HVAC) systems. Specifically, this invention relates to an improved apparatus for introducing steam into an airstream in such a system.

2. Description of the Prior Art

Air that contains an inadequate amount of humidity can cause problems that range in severity from merely annoying to extremely expensive or even life threatening. Dry air can make people more susceptible to colds, sore throats and other respiratory problems. It can draw moisture out of materials such as carpet, wood, paper, leather, vinyls, plastics and foods. It can also contribute to the generation of static electricity, which can damage electronically sensitive tapes and disks.

Most modern commercial and industrial buildings are equipped with steam humidifiers mounted within the heating and air conditioning systems. Steam from a steam boiler or district steam system is introduced into the ductive airstream and distributed throughout the building. Humidification steam cannot be allowed to condense into water in a duct system. Damp areas in ducts become breeding grounds for algae and bacteria, many of which are disease-producing to humans, contaminating to industrial processes, and so forth.

To prevent condensation in the duct the steam must be totally absorbed by the air before the air carries the steam into contact with any internal devices such as dampers, fans, turning vanes etc., within the duct. The more thoroughly the steam is mixed with the air, the shorter the distance it will travel within the duct before becoming absorbed by the air.

Some duct configurations, due to structural limitations imposed by the building design, have very limited open space downstream of the humidifier for absorption of the steam. Closely spaced multiple steam dispersing tubes provide the degree of mixing of steam and air necessary to satisfy those jobs at the present time.

Steam humidifier dispersion tubes can present two operational difficulties when installed in a closely spaced arrangement. Present day steam dispersion tubes are usually constructed with a hot outer jacket which contains steam. The purpose of this is to keep the tube hot, thus preventing condensation from the humidification steam forming as it passes through the tube. In closely spaced multiple tube arrangements, such a configuration can present an impediment to air flow within the ducting system. Even more importantly, such configurations often add unwanted heat to the airstream due to the exposed outer surface of the hot jacketing adding an unnecessary refrigeration load during periods of cooling. Insulating the exterior surfaces of the hot jacketing can reduce the heat gain, but further aggravates the air flow resistance problem. An automatic valve can be placed in the steam line supplying steam to the tube jackets and cycling it off and on with the humidifier steam valve. When this has been done in many cases the flexing of the tubes due to flexing caused by heating and cooling has led to eventual cracking of jacket welds.

It is clear there has existed a long and unfilled need in the prior art for a steam injection humidification system that is unaffected by condensation problems, and that is capable of introducing humidity into an airstream consistently and effectively.

SUMMARY OF THE INVENTION

Accordingly, it is an object of this invention to provide a steam injection humidifier that is largely unaffected by condensation problems.

It is further an object of this invention to provide a steam injection humidification system that is more consistent in introducing humidity into an airstream than those which are heretofore known.

It is yet further an object of the invention to provide a steam injection humidifier which accomplishes improved performance while eliminating the attendant problems of resistance to air flow and unwanted heat gain to the airstream.

It is also an object of the invention to provide an injection-type steam humidification system which provides improved mixing action of steam and air over those systems which are presently known.

In order to achieve these and other objects of the invention, an apparatus for introducing steam into an airstream in an HVAC humidification system according to the invention may include a supply header which is adapted for connection to a source of steam; steam dispersion structure positioned downstream of the supply header for receiving steam from the supply header and for dispersing a percentage of such steam into an airstream; and structure for collecting excess steam and condensation from the steam dispersion structure, the collecting structure being adapted for connection to a fluid drain, whereby condensation is effectively removed from the apparatus without escaping into the airstream or associated elements of an HVAC system.

According to another aspect of the invention, an apparatus for introducing steam into an airstream in an HVAC humidification system includes at least one tube having a first inlet end which is adapted to be connected to a source of steam and a second outlet end which is adapted to be connected to a liquid and steam collecting structure; the tube having a plurality of radial holes defined therein; a plurality of nozzles inserted, respectively, in the radial holes, the nozzles each having an axial bore defined therein for conducting steam away from the tube into an airstream; and fender structure connected to an upstream side of the tube for insulating the tube against unwanted heat transfer from the tube to the airstream, whereby condensation within the tube is kept to a minimum, and resistance to airflow is minimized within the duct.

According to another aspect of the invention, an apparatus for introducing steam into an airstream includes a supply header which is adapted to be connected to a source of steam, the supply header having an outer wall defining a space therein; and a dispersion tube having at least one nozzle therein for dispersing steam into an airstream, the tube having a first end which extends through the outer wall for a distance into the space, thereby forming a collection space in the supply header in which condensation may collect.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
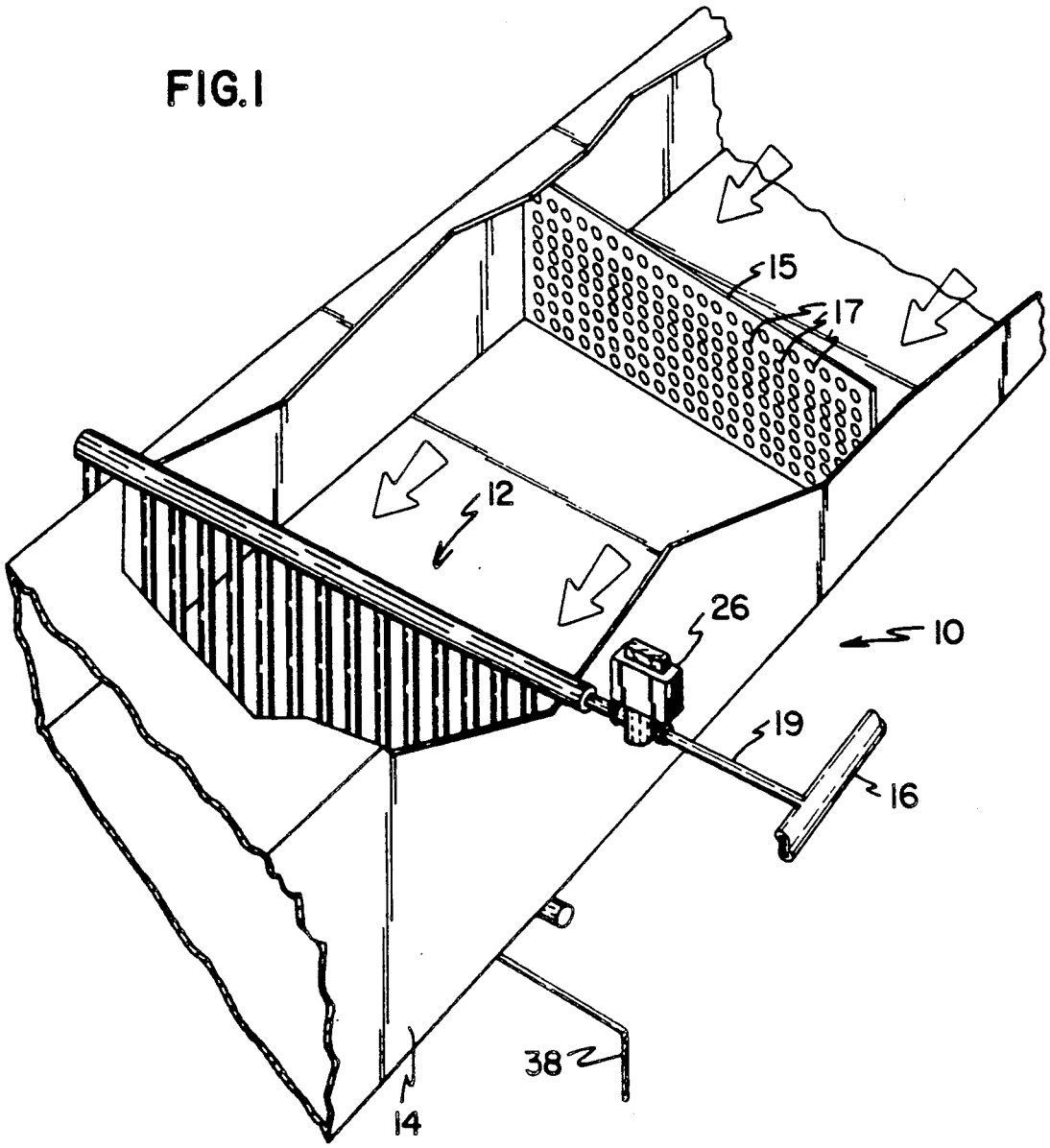
FIG. 1 is a fragmentary perspective view of an HVAC humidification system constructed according to a preferred embodiment of the invention.

Referring now to the drawings, wherein like reference numerals designate corresponding structure throughout the views, and referring in particular to Figure 1, an improved HVAC humidification system 10 includes a multiple tube dispersion unit 12 that is secured so as to be partially within an HVAC duct 14 by one or more mounting members (not shown) which are of conventional design. A steam supply line 16 is provided from an external source, such as an in-house boiler or district steam system.

Referring again to FIG. 1, the direction of air flow within duct 14 is indicated by the arrows. To provide improved, consistent mixing action of steam and air, a perforated diffuser plate is positioned in duct 14 slightly upstream from the multiple tube dispersion unit 12. In the preferred embodiment, diffuser plate 15 is a flat plate containing a plurality of evenly spaced perforations or holes 17. In operation, pressure builds up on the upstream side of diffuser plate 15. The constant pressure allows air to escape through each of the evenly spaced holes 17 at a common flow rate. Since holes 17 are spaced evenly over the surface of diffuser plate 15, the air flow immediately upstream of dispersion unit 12 is thus constrained to be substantially even and constant over the entire cross section of duct 14. As a result, an even steam-to-air mixing takes place at the plane within duct 14 at which dispersion unit 12 is located.

Figure 2:
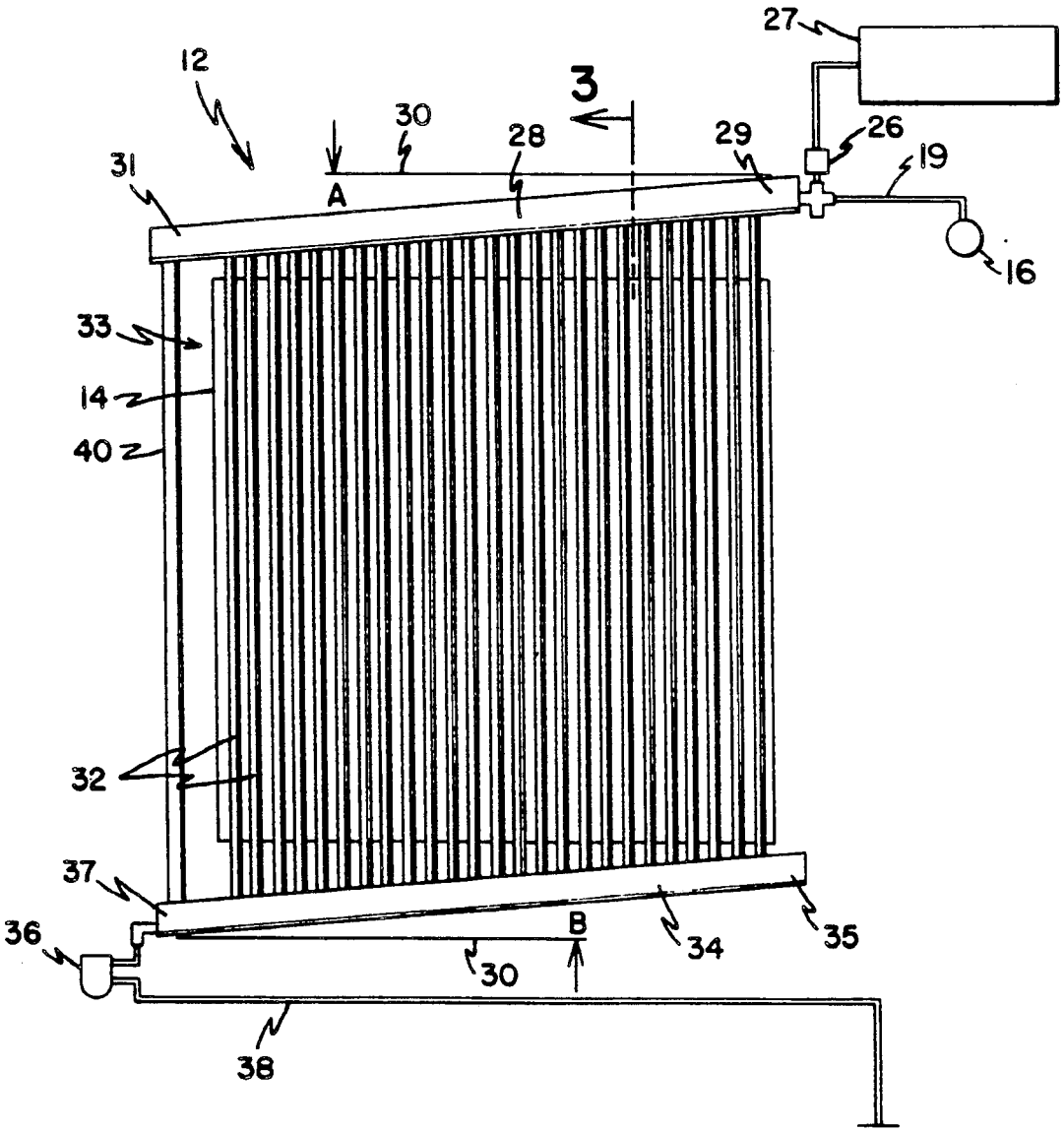
FIG. 2 is a partially schematic diagram depicting a portion of the system illustrated in FIG. 1.

Referring now to FIG. 2, steam from supply line 16 is supplied to dispersion unit 12 via a steam line 19. A control valve 26 is interposed in steam dispersion line 19 for regulating the amount of steam that is allowed to flow into dispersion unit 12. A control system 27, the details of which will be known to those skilled in the art, is arranged so as to selectively open or close control valve 26.

Referring again to FIG. 2, dispersion unit 12 includes a longitudinally extending supply header 28 which is connected at a first end 29 to steam line 19. The first end 29 of supply header 28 is elevated with respect to a second, opposite end 31. As a result, the longitudinal axis of supply header 28 is inclined with respect to a horizontal plane 30 at an angle A, as may be seen in Figure 2. As a result, any condensation which forms within supply header 28 is caused to drain toward second end 31. It should be understood that header 28 could be vertical if tilted at a different angle to achieve the same effect.

Dispersion unit 12 includes a steam dispersion portion 33 that is constructed of a plurality of elongate tubes 32. In the preferred embodiment, the tubes 32 are mounted so that their longitudinal axes are substantially vertical and parallel to each other. Alternatively, however, they could be tilted at another, lesser angle with respect to the horizontal, as long as the second end position is beneath first end portion 42. Each of the tubes 32 are connected at a first end portion 42 to supply header 28, and at a second end portion to a return header 34. The preferred construction of tubes 32 will be described in greater detail below.

As may be seen in FIG. 2, return header 34 extends longitudinally between a first end 35 and a second, opposite end 37. First end 35 is elevated with respect to second end 37. As a result, the longitudinal axis of return header 34 is inclined with respect to a horizontal plane 30 by an angle B, as is shown in FIG. 2. Angle A is preferably the same or greater than Angle B. Condensation in return header thus tends to flow toward second end 37 and into a steam trapping device which in the preferred embodiment is a standard steam trap 36 of the type which is well known in the art, which is connected to second end 37. A drain line 38 is provided to conduct condensate from steam trap 36, as may be seen in FIG. 2.

Looking again to FIG. 2, a condensation drain line 40 is provided to guide condensed water from the second end 31 of supply header 28 to the second end 37 of return header 34, and thus into steam trap 36.

Figure 3:
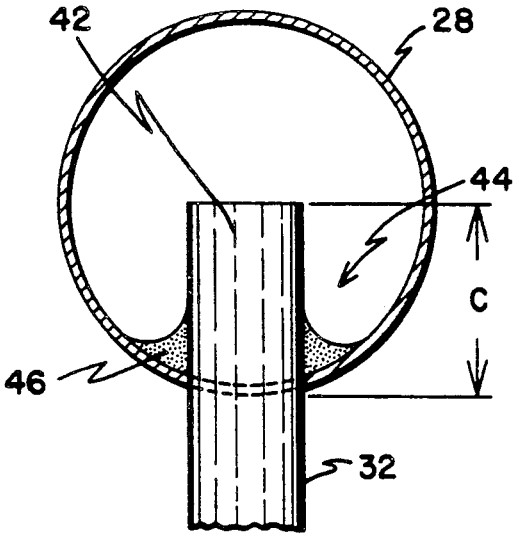
FIG. 3 is a fragmentary cross-sectional view taken along 3-3 in FIG. 2.

Referring now to FIG. 3, the first end portion 42 of each of the tubes 32 extends through an outer wall of supply header 28 for some distance into a space which is defined within the supply header 28. Preferably, supply header 28 is circular in cross-section, and the first end portion 42 terminates in a plane which contains the longitudinal axis of supply header 28, as is shown in FIG. 3. Since first end portion 42 extends for some distance into the supply header 28, a collection space 44 is formed in a lower half of supply header 28 in which condensation may collect. As a result, the condensation is prevented from entering the tubes 32. The collected condensation 46 is shown in FIG. 3. Condensation 46 will flow toward the second end 31 of supply header 28 due to the inclination of supply header 28, and into the condensation drain line 40 as has previously been described.

Figure 4:
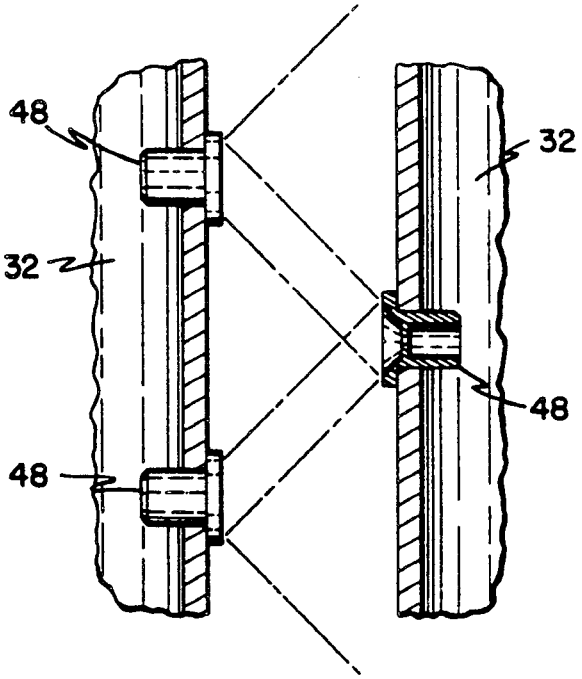
FIG. 4 is an enlarged fragmentary crosssectional view taken through one of the dispersion tubes depicted in FIG. 2.
Figure 5:
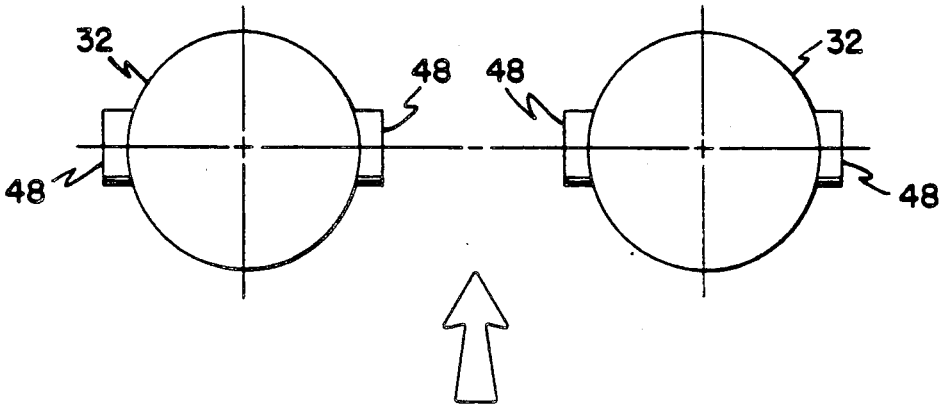
FIG. 5 is a diagrammatical view depicting a feature of the embodiment shown in FIGS. 1–4.

As may be seen in FIG. 4, a plurality of vapor nozzles 48 are mounted within holes defined radially in the outer wall of each of the tubes 32. Each of the vapor nozzles 48 have an orifice defined therein for allowing a predetermined flow rate of vapor to pass therethrough at a given input pressure. In a first embodiment which is shown in FIG. 5, nozzles 48 are positioned with respect to the respective tubes 32 so that the bores therein are substantially aligned along a plane which contains the longitudinal axes of the parallel tubes 32. The direction of the air flow is shown in FIG. 5 by an arrow.

As shown in FIG. 4, the nozzles 48 protrude well inwardly of the inside cylindrical surface, preferably to the center, of the respective tubes 32. As a result, the condensation that forms and will naturally adhere to the inside surfaces of tubes 32 will drain downwardly along the inside surface and into the return header 34, rather than being expelled into the airstream through the nozzle 48. This feature of the invention, in conjunction with the structure that is described above with regard to FIG. 3, ensures that condensation is efficiently drained from the unit rather than escaping into the airstream that is to be humidified.

Figure 6:
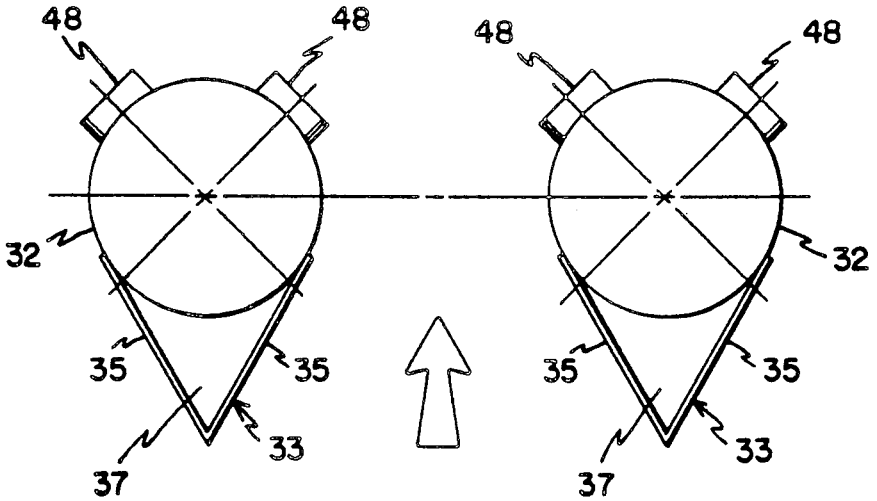
FIG. 6 is a diagrammatical view which corresponds to the view of FIG. 5 and depicts a second embodiment of one aspect of the invention.

In a second embodiment which is illustrated in FIG. 6, the nozzles 48 are located so that their axial bores are positioned at an acute angle with respect to the plane which contains the longitudinal axes of the tubes 32. The nozzles 48 are positioned on the side of the tubes 32, which is downstream from the direction of the air flow, as it is indicated by the arrow in FIG. 6. Preferably, the nozzles 48 on each of the tubes 32 are symmetrical with respect to the direction of the air flow, which in FIG. 6 is substantially perpendicular to the plane containing the longitudinal axes of tubes 32. In practice, the embodiment shown in FIG. 5 is better suited for use in systems having a relatively high velocity air flow. Conversely, the embodiment shown in FIG. 6 is better suited for use in systems having a lower air flow velocity.

Another important feature of the embodiment of the invention which is illustrated in FIG. 6 is the provision of wedge-shaped fenders 33 on the upstream side of each of the tubes 32. In the embodiment which is illustrated in FIG. 6, each fender 33 is formed by a pair of plates 35 which are joined to each other at a first end, and are fastened to opposite sides of a tube 32 on a second end thereof. The plates 35 thus create a dead air space 37 which provides insulation against heat transfer between the airstream and the tube 32. As a result, a dispersion tube 32 having a fender 33 mounted thereon will transmit less heat to the airstream than it would without the fender 33, while still being able to inject steam into the airstream through nozzles 48. A secondary benefit of the diminished heat transfer between tubes 32 and the airstream with the provision of fenders 33 is that less condensation will occur within the tubes 32, thereby improving the overall efficiency of the system. The fenders 33 also serve to streamline the cross-section of the tube relative to the direction of air flow, thus decreasing air flow resistance. Although the fenders 33 are illustrated only with respect to the embodiment of the invention which is shown in Figure 6, it is to be understood that such fenders could likewise be used in the embodiment shown in FIG. 5, or in other, equivalent embodiments according to the spirit of the invention.

Figure 7:
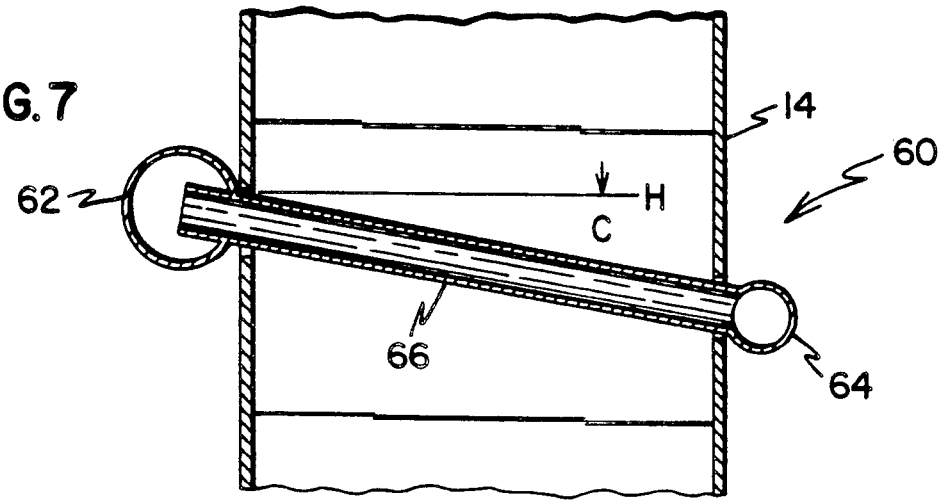
FIG. 7 is a fragmentary cross-sectional view of a second embodiment of a second aspect of the invention.

Referring now to FIG. 7, a second embodiment 60 of an improved HVAC humidification system includes a supplier header 62 and a return header 64 which are mounted externally of a vertically-extending HVAC duct 14. As may be seen in FIG. 7, return header 64 is positioned at a level that is beneath the level at which supplier header 62 is positioned. As a result, the plurality of elongate steam dispersion tubes 66 which extend between supply header 62 and return header 64 are inclined with respect to a horizontal plane H at an angle C. As a result, condensation within the elongate tube 66 is caused to run downwardly into the return header 64, which is connected to a drain pipe in the manner shown in FIG. 2. Preferably, supply header 62 and return header 64 are both slightly inclined with respect to the horizontal plane H, so that condensation therein can be collected and drained in the manner that is shown and described with respect to Figure 2. The system illustrated in FIG. 7 is identical in all other aspects to that shown in FIGS. 1-5.

Figure 8:
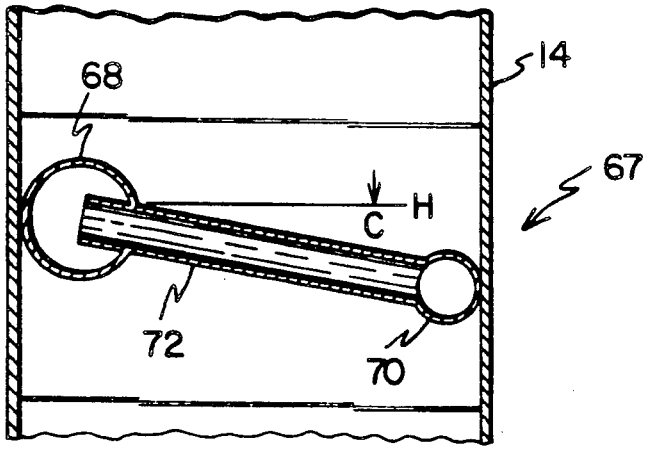
FIG. 8 is a fragmentary cross-sectional view of a third embodiment of the second aspect of the invention.

Looking now to FIG. 8, an improved HVAC humidification system 67 constructed according to a third embodiment of the invention includes a supply header 68 and a return header 70, both of which are positioned within a vertically-extending duct 14. An elongate tube 72 extends from supply header 68 to return header 70. Supply header 68 is elevated with respect to return header 70, and elongate tube 72 thus is inclined with respect to a horizontal plane H at an angle C. The system 67 illustrated in FIG. 8 is identical in all other respects to the system 60 which has previously been shown and described with respect to FIG. 7. Generally, the system illustrated in FIG. 7 is preferable for use in vertically-extending ducts wherein sufficient external space is available to accommodate supply header 62 and return header 64.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extend indicated by the broad general meaning of the terms in which the appended claims are expressed.

What is claimed is:

1. An apparatus for introducing steam to an airstream in an HVAC humidification system, comprising:

supply header means having a first end which is adapted for connection to a source of steam and a second end, said first end being elevated with respect to said second end, whereby condensation will flow toward said second end;

steam dispersion means positioned downstream of said supply header means for receiving steam from said supply header means and for dispersing a percentage of such steam into an airstream; and means for collecting condensation from said steam dispersion means, said collecting means being adapted for connection to a fluid drain, whereby condensation is efficiently removed from the apparatus without escaping into the airstream or associated elements of an HVAC system.

2. An apparatus according to claim 1, wherein said steam dispersion means comprises at least one tube having a first upper end connected to said supply header means and a second lower end connected to said collecting means, said tube having at least one nozzle therein for introducing steam into an airstream.

3. An apparatus according to claim 2, wherein said supply header means has an outer wall defining a space therein, and wherein said firs end of said tube extends through said outer wall for a distance into said space, thereby forming a collection space in said supply header means in which condensation may collect.

4. An apparatus according to claim 3, further comprising a drain line connected to said supply header means, said drain line being in communication with said collection space, whereby condensation from said collection space may be drained.

5. An apparatus according to claim 1, wherein said collecting means comprises a return header.

6. An apparatus according to claim 5, wherein said apparatus is adapted to be mounted to an HVAC system so that said supply header means is elevated with respect to said return header.

7. An apparatus according to claim 5, wherein said return header has a first end; and a second end that is adapted for connection to a fluid drain; and said first end is elevated with respect to said second end, whereby gravity causes condensation in said return header to flow toward said second end and into the fluid drain.

8. A system for humidifying an airstream comprising:

a duct for guiding an airstream supply header means having a first end which is adapted for connection to a source of steam and a second end;

steam dispersion means positioned downstream of said supply header means for receiving steam from said supply header means and for dispersing a percentage of such steam into an airstream;

means for mounting said steam dispersion means within said duct, said mounting means being oriented so as to position said first end of said supply header means above said second end so as to cause condensation in said supply header means to flow toward said second end; and means for collecting condensation from said steam dispersion means, said collecting means being adapted for connection to a fluid drain, whereby condensation is efficiently removed from the system without escaping into the airstream.

9. A system according to claim 8, wherein said steam dispersion means comprises at least one tube having a first upper end connected to said supply header means and a second end connected to said collecting means, said tube having at least one nozzle therein for introducing steam into an airstream.

10. An apparatus according to claim 9, wherein said mounting means mounts said steam dispersion means so that said tube is substantially vertical.

11. A system according to claim 9, wherein said supply header means has an outer wall defining a space therein, and wherein said first end of said tube extends through said outer wall for a distance into said space, thereby forming a collection space in said header means in which condensation may collect.

12. A system according to claim 11, further comprising a drain line connected to said supply header means, said drain line being in communication with said collection space, whereby condensation from said collection space may be drained.

13. A system according to claim 8, wherein said collecting means comprises a return header.

14. An apparatus according to claim 13, wherein said supply header means is elevated with respect to said return header.

15. A system according to claim 13, wherein said return header has a first end, and a second end that is adapted for connection to a fluid drain, and said mounting means mounts said steam dispersion means relative to said duct so that said first end is elevated with respect to said second end, whereby gravity causes condensation in said return header means to flow toward said second end and into the fluid drain.

16. An apparatus for introducing steam into an airstream in an HVAC humidification system, comprising:

at least one tube having a first inlet end which is adapted to be connected to a source of steam and a second outlet end which is adapted to be connected to a liquid and steam collecting structure, said tube having a plurality of radial holes defined therein;

a plurality of nozzles inserted, respectively, in said radial holes, said nozzles each having an axial bore defined therein for conducting steam from said tube into an airstream; and fender means connected to an upstream side of said tube for insulating said tube against unwanted heat transfer from said tube to the airstream, whereby condensation within said tube is kept to a minimum and resistance to airflow within the duct is minimized.

17. An apparatus according to claim 16, wherein said fender means comprises a V-shaped member.

18. An apparatus according to claim 17, wherein said V-shaped member comprises a pair of plate members, each of which are fastened to each other at a first end and to said tube at opposite sides at their second end.

19. An apparatus for introducing steam into an airstream, comprising:

a supply header which is adapted to be connected to a source of steam, said supply header having an outer wall defining a space therein;

a plurality of dispersion tubes each having at least one nozzle therein for dispersing steam into an airstream; each of said tubes having a first end which extends through said outer wall for a distance into said space, thereby forming a collection space in said supply header in which condensation may collect, and a second opposite end; and a return header which is in communication with said second ends of said dispersion tubes for collecting condensation which forms within said dispersion tubes.

20. A system for humidifying an airstream, comprising:

a duct for guiding an airstream;

a supply header which is adapted for connection to a source of steam;

steam dispersion means positioned downstream of said supply header for receiving steam from said supply header and for dispersing a percentage of such steam into an airstream;

means for mounting said steam dispersion mans within said duct; and a return header for collecting condensation from said steam dispersion means, said supply header being elevated with respect to said return header, and said return header being adapted for connection to a fluid drain, whereby condensation is efficiently removed from the system without escaping into the airstream.

21. A system for humidifying an airstream, comprising:

a duct for guiding an airstream;

a supply header which is adapted for connection to a source of steam;

at least one tube positioned downstream from said supply header for receiving steam from said supply header and for dispersing a percentage of such steam into an airstream, said tube having a first upper end connected to said supply header, a second end and at least one nozzle therein for introducing steam into the airstream;

means for mounting said tube within said duct so that said tube is substantially vertical; and means for collecting condensation from said tube, said collecting means being adapted for connection to a fluid drain, whereby condensation is efficiently removed from the system without escaping into the airstream.

22. An apparatus for introducing steam into an airstream in an HVAC humidification system, comprising;

a supply header which is adapted for connection to a source of stream;

a plurality of steam dispersion tubes, each of said dispersion tubes having a first end which is in communication with said supply header and being inclined with respect to a horizontal plane so that condensation forming therein will flow downwardly away from said first end toward a second, opposite end, each of said tubes having at least one nozzle therein for introducing steam into an airstream; and means in communication with said second ends of said steam dispersion tubes for draining condensation from said steam dispersion tubes, said draining means being adapted for connection to a fluid drain, whereby condensation is efficiently removed from the apparatus without escaping into the airstream or associated elements of an HVAC system.

23. An apparatus for introducing steam into an airstream in an HVAC humidification system, comprising:

a supply header which is adapted for connection to a source of steam;

a plurality of steam dispersion tubes, each having a first end which is in communication with said supply header, and a lower second end, each of said steam dispersion tubes having at least one nozzle therein for introducing steam into an airstream; and a return header in communication with said second ends of said steam dispersion tubes, said return header being positioned beneath said supply header.

24. An apparatus according to claim 23, further comprising a drain line connected to said supply header at a first end and to said return header at a second end, whereby condensation in said supply header is drained into said return header without passing through said steam dispersion tubes.

25. An apparatus for introducing steam into an airstream in an HVAC humidification system, comprising:

a supply header which is adapted for connection to a source of steam;

a plurality of steam dispersion tubes, each having a first end which is in communication with said supply header, and a second end, each of said steam dispersion tubes having at least one orifice defined therein for introducing steam into an airstream;

means in communication with said second ends of said steam dispersion tubes for draining condensation from said steam dispersion tubes; and a diffuser plate positioned in spaced relation with respect to said steam dispersion tubes, said diffuser plate having a plurality of perforations defined therein for creating a constant and even airflow towards said dispersion tubes.

26. An apparatus for introducing steam into an airstream in an HVAC humidification system, comprising:

a supply header which is adapted for connection to a source of steam;

a plurality of steam dispersion tubes, each having a first end which is in communication with said supply header, and a lower second end, each of said steam dispersion tubes having at least one orifice defined therein for introducing steam into an airstream; and means in communication with said second ends of said steam dispersion tubes for draining condensation form said steam dispersion tubes, said draining means being adapted for connection to a fluid drain, whereby condensation is efficiently removed from the apparatus without escaping into the airstream or associated elements of an HVAC system.

* * * * *